US006491089B1

(12) United States Patent
Poirier et al.

(10) Patent No.: US 6,491,089 B1
(45) Date of Patent: Dec. 10, 2002

(54) PROCESS FOR MANUFACTURING CARBON-STEEL STRIP BY TWIN-ROLL CONTINUOUS CASTING, PRODUCT PRODUCED AND APPARATUS

(75) Inventors: François Poirier, Dunkirk (FR); Françoise Commarieu, Dunkirk (FR); Christian Marchionni, Rosselange (FR); Patrice Vicente, Metz (FR); Michel Faral, Metz (FR); Jacques Selaries, Metz (FR)

(73) Assignee: Sollac, Puteaux (FR)

( * ) Notice: Subject to any disclaimer, the term of this patent is extended or adjusted under 35 U.S.C. 154(b) by 0 days.

(21) Appl. No.: 09/531,455

(22) Filed: Mar. 20, 2000

(30) Foreign Application Priority Data

Mar. 26, 1999 (FR) ..... 99 03778

(51) Int. Cl.[7] ..... B22D 11/06
(52) U.S. Cl. ..... 164/480; 164/428; 164/475
(58) Field of Search ..... 164/433, 482, 164/480, 428, 472, 475

(56) References Cited

U.S. PATENT DOCUMENTS 4,593,742 A * 6/1986 Hazelett et al. ..... 164/415
5,010,947 A * 4/1991 Yukumoto et al. ..... 164/428
5,103,895 A * 4/1992 Furuya et al.
5,227,251 A * 7/1993 Suichi et al.
5,520,243 A * 5/1996 Freeman et al. ..... 164/478
5,701,948 A * 12/1997 Strezov et al. ..... 164/428

FOREIGN PATENT DOCUMENTS

| | | |
|---|---|---|
| EP | 0 740 972 | * 11/1996 |
| EP | 0796 685 | * 9/1997 |
| JP | 1-129996 | * 5/1989 |
| JP | 3-873 | * 1/1991 |
| JP | 5-212505 | * 8/1993 |
| JP | 5-261491 | * 10/1993 |

OTHER PUBLICATIONS

Michael Field, et al., "Surface Finish and Surface Integrity", *Metals Handbook,* 9th Edition, vol. 16, "Machining", Mar. 1989, pp. 19–20.

Database WPI, Section Ch, week 199606, Derwent Publications Ltd., London, GB; XP002125792 with JP 07–314097, Dec. 5, 1995.*

* cited by examiner

*Primary Examiner*—M. Alexandra Elve
*Assistant Examiner*—Len Tran
(74) *Attorney, Agent, or Firm*—Oblon, Spivak, McClelland, Maier & Neustadt, P.C.

(57) ABSTRACT

A process for manufacturing carbon-steel strip having a thickness of less than or equal to 10 mm directly from liquid steel, by casting said liquid steel between the lateral surfaces, made of copper or copper alloy, of two internally cooled rotating horizontal rolls.

11 Claims, 1 Drawing Sheet

PROCESS FOR MANUFACTURING CARBON-STEEL STRIP BY TWIN-ROLL CONTINUOUS CASTING, PRODUCT PRODUCED AND APPARATUS

BACKGROUND OF THE INVENTION

1. Field of the Invention

The invention relates generally to the continuous casting of metal. It relates more particularly to the casting of thin carbon-steel strip on plants of the type known as "twin-roll casters".

2. Discussion of the Background

Considerable progress has been made in recent years in the development of processes for casting thin steel strip directly from liquid metal. The process mainly used at the present time is the casting of said liquid metal between two internally cooled rolls, rotating about their horizontal axes in opposite directions and placed opposite each other, the minimum distance between their surfaces being approximately equal to the thickness that it is desired to confer on the cast strip (for example a few mm). The casting space containing the liquid steel is defined by the lateral surfaces of the rolls, on which surfaces the strip starts to solidify, and by side closure plates made of refractory, which are applied against the ends of the rolls. The liquid metal starts to solidify on contact with the outer surfaces of the rolls, on which surfaces solidified "shells" form, arrangements being made for these shells to meet in the region of the "nip", that is to say the region where the distance between the rolls is a minimum.

These casting processes are used both for casting carbon steel and for casting stainless steels or other ferrous alloys. However, the industrial application of twin-roll casting to carbon steels cannot be envisaged in an acceptable manner unless it is possible to obtain, in a constant manner, a strip surface quality sufficient for the subsequent treatments undergone by this strip (cold rolling operations, surface treatments, etc) to be possible and to result in the formation of products free of unacceptable defects. It is, in particular, of paramount importance for the strip produced by a twin-roll casting plant to be free of surface cracks, called crazes, because otherwise serious incidents may occur during its cold rolling.

In order to try to avoid such crazing, solutions have already been proposed which involve giving the surface of the casting rolls a particular texture, namely a succession of contiguous and parallel grooves, preferably combined with a silicon-manganese killed cast metal having a high sulfur content, of greater than 0.02% (document EP-A-0,740,972). However, this solution complicates the preparation of the rolls compared with the more conventional methods of preparation and, under its optimum conditions, limits the field of application of the cast products to those in which the high sulfur content of the metal is tolerable.

OBJECTS OF THE INVENTION

One object of the invention is to provide a process for manufacturing thin carbon-steel strip by twin-roll casting, resulting in the reliable production of strip free of surface crazing, this method having neither to limit the field of application of the products nor to necessarily lead to the use of long and complex methods for preparing the surface of the rolls. The apparatus involved and the products produced are also objects of the invention.

SUMMARY OF THE INVENTION

In accord with the objects, one subject of the invention is a process for manufacturing carbon-steel strip having a thickness of less than or equal to 10 mm directly from liquid steel, by casting said liquid steel between the lateral surfaces, made of copper or copper alloy, of two internally cooled rotating horizontal rolls, wherein preferably:

said liquid steel has the composition, in percentages by weight based on total weight: carbon≦0.5%, manganese from 0.2 to 2%, silicon≦2%, the %Mn/%Si ratio being between 3 and 16, and optionally aluminum+titanium+zirconium≦0.10%, and containing of course iron and the usual impurities;

said lateral surfaces of the rolls have contiguous dimples, giving said surfaces a roughness Rz of between 40 and 200 μm and a roughness Ra of between 10 and 40 μm; and the atmosphere surrounding the meniscus of the liquid steel present between the rolls contains between 40 and 100% nitrogen, the balance preferably being composed of an inert gas insoluble in the liquid steel or of a mixture of such inert gases.

As noted, the invention also relates to strip produced by this process, as well as to the casting rolls necessary for its practical implementation.

Generally speaking, the invention indues combining particular conditions regarding the composition of the steel, the surface finish of the rolls and the composition of the atmosphere surrounding the surface of the liquid steel present between the rolls. The inventors have found that such a combination results in the uniform production of products having the required surface quality. The conditions under which this process is preferably carried out also have the advantage of not resulting in a casting process substantially more restrictive than the usual processes. In addition, the process of the invention requires that no action be taken on the composition of the metal, which would appreciably increase the cost of the strip, since it is not necessary to add expensive alloying elements to the liquid metal or to impose on the liquid metal unusually low contents of certain elements. Likewise, the ranges of use of products manufactured from the strip thus produced are not limited by the presence, in amounts higher than is customary, of elements such as sulfur, which could radically impair the mechanical properties of said products. Finally, this invention does not require increasing the heat flux to be extracted from the liquid metal by the rolls, whereas such an increase could be damaging to the service life of the cooled external surface of said rolls.

BRIEF DESCRIPTION OF THE DRAWINGS

The invention will be more clearly understood on reading the description which follows, given with reference to the following appended figures.

DESCRIPTION OF THE PREFERRED EMBODIMENTS

Figure 1:
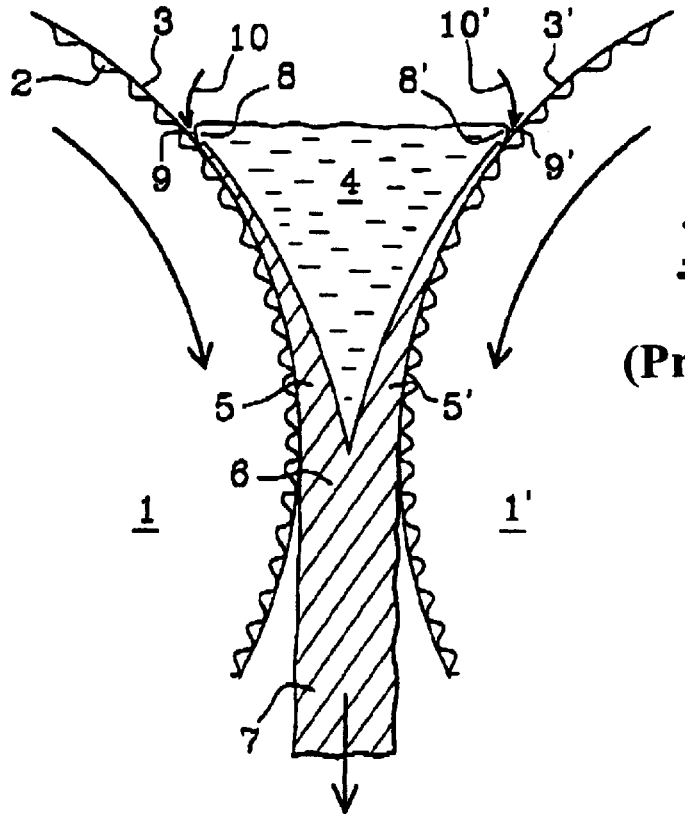
FIG.1 (Prior art)
FIG. 1, which diagrammatically illustrates, seen from the front and in cross section, the casting space of a twin-roll casting plant, showing therein the behavior of the meniscus of the liquid steel present between the casting rolls under conditions corresponding to those of the prior art.

An important condition for obtaining a twin-roll-cast strip free of surface crazes is to obtain good anchoring of the shells of the strip to the entire surface of the rolls during solidification. Such anchoring guarantees that the various stresses associated with the thermal contractions and with possible changes of phase undergone by the shells are distributed uniformly, whereas heterogeneites in these stresses may cause surface crazes. It is therefore recommend that casting rolls whose surface has a relatively high roughness, preferably in the form of "dimples," be used. These dimples, as is known (see, for example, document EP-A-0,796,685, incorporated herein by reference), are depressions of roughly circular or oval shape that may be provided on the surface of the roll by blasting it with metal or ceramic balls. Under these conditions, during solidification, the metal shells penetrate the dimples, the penetration being deeper the larger the diameter of the dimples. They therefore behave like points for anchoring the shells to the rolls.

Preferably, this penetration is not too great, for several reasons. If the dimples are deeper than 200 $\mu$m on average and if the steel during solidification completely fills them, the surface of the strip will have "as a negative" the raised image of the dimples, in other words bumps, which are not generally desirable in the end-product. During any subsequent rolling that the strip undergoes, these bumps will then have to be flattened, and such flattening is not always sufficiently possible with the reduction rates normally employed on twin-roll cast strip. Moreover, it is not always desirable for the contact between the solidifying shell and the surface of the roll to be very intimate, as this would result in a very large heat flux extracted from the metal by the roll. It contributes to the rapid degradation of the surface of the rolls, accentuating the fatigue phenomena therein.

Conventional indices describing the roughness of the surface of rolls are the index Ra and the index Rz. Considering the surface of the rolls to be a succession of projections and hollows with respect to a mean level, and assuming that these projections and hollows have a height or a depth y, Ra and Rz are, according to the standards in force, calculated in the following manner.

Over a given length L (in this case equal to the circumference of the roll), $$Ra = \frac{1}{L}\int_0^L |y(x)|dx$$

Over a given length $L_i$, equal to ⅕ of the circumference of the roll (i varying from 1 to 5), $$Rzi = \frac{\sum_{i-j}^{5} Yp_i + \sum_{i=1}^{5} Yv_i}{5}$$

$Yp_i$ (i varying from 1 to 5) being the height of the 5 highest projections and $Yv_i$ (i varying from 1 to 5) being the depth of the 5 deepest hollows. Then, according to the DIN 4768 standard, incorporated herein by reference, the following equation may be written:

$$Rz = \frac{1}{5}(Rz_1 + Rz_2 + Rz_3 + Rz_4 + Rz_5)$$

In the process according to the invention, these dimples preferably are contiguous, that is to say their peripheries are not systematically separated by lands. This is because an alternation of wide lands, where there is intimate contact between the metal and the roll, and of dimples, where this contact is less close, may be unfavorable to the formation of a strip surface free of crazes since, in this case, the highly cooled regions are present in a proportion which may be too high. Preferably, the dimples are distributed randomly. In addition, the absence of lands means that there are more anchoring points for the solidified shell.

Another factor to be taken into consideration is the composition of the gas which is used to provide an inert atmosphere surrounding the meniscus, that is to say the periphery of the surface of the liquid metal present between the rolls, at which the shells start to solidify. This is because the dimples, when they come into contact with the meniscus, contain gas, which therefore remains trapped between the bottom of each dimple and the solidifying shell. Depending on its physicochemical characteristics, this gas will have an influence on the conditions of formation of the shells. Experience shows that if this gas is insoluble in the steel (which is the case with, e.g., argon and helium), it forms a gas "blanket" which may prevent deep penetration of the metal into the dimples. This may contribute toward reducing the formation of crazes through the effect of the stresses associated with the contraction of the shell as it solidifies and cools. However, craze formation by another mechanism may also be observed: expansion of the gas may result locally in loss of contact between the shell and the roll, which slows down the rate of heat transfer excessively. Locally, the shell embrittles, this being favorable to craze formation. It is also possible, in some cases, to find a hollowed marking on the strip if the expansion of the insoluble gas has been great enough to push back the solidifying shell. Penetration also provides good anchoring of the shell to the roll, something which, as already mentioned, is conducive to homogeneous heat transfer over the entire surface of the shell and therefore contributes to reducing the formation of surface crazes. There is no inerting gas composition which, in absolute terms, is universally ideal, and this composition preferably is able to be adjusted according to the other operating conditions as required during the casting itself, which is within the ordinary skill of the artisan.

The conditions for the surface of the roll to be wetted by the liquid steel at the meniscus are also very important for establishing heat transfer. They depend in particular on the composition of the liquid metal, and can be adjusted accordingly based upon the present specification teachings by one of ordinary skill in the art.

FIG. 1 shows diagrammatically the casting space of an apparatus for the continuous casting of thin metal strip between two internally cooled parallel rolls 1, 1' rotating about their axes, which are kept horizontal. Dimples 2 are provided on their external surfaces 3, 3' which are made of copper or copper alloy. Liquid steel 4 is present in the casting space defined by the surfaces 3, 3', to where it is brought from a vessel called a tundish by means of a refractory nozzle (not shown). On contact with the surfaces 3, 3', the liquid steel 4 solidifies to form shells 5, 5' whose thickness gradually increases as they move toward the bottom of the casting space due to the effect of the rotation of the rolls 1, 1'. The shells 5, 5' meet in the nip 6 to form an entirely solidified strip 7, which is extracted from the casting space by a conventional extractor device (not shown), for example, pinch rollers. As shown, the surfaces of the shells 5, 5' penetrate into the dimples 2, thereby giving the surface of the strip 7 a slightly bumped shape. For the sake of clarity in the figure, the scale of the various parts of the apparatus has not been respected. By way of example, the rolls 1, 1' generally have a diameter ranging from 500 to 1,500 mm, the diameter and the depth of the dimples 2 are of the order of several tens to several hundreds of $\mu$m and the strip thickness is a few mm (up to 10 mm, usually 2 to 6 mm).

Normally, the conditions whereby the surfaces 3, 3' of the rolls 1, 1' are wetted by the liquid steel 4 during the casting of carbon steels make the meniscus 8 adopt the shape shown in FIG. 1, that is to say that there may be an acute contact angle between the steel 4 and the surface 3, 3'. At the meniscus 8, 8', there is therefore a gap 9, 9' between the liquid steel 4 and the surface 3, 3' of the roll 1, 1'. Because of the effect of the rotation of the rolls 1, 1', the gas forming the atmosphere surrounding the meniscus 8, 8' is therefore entrained into the dimples 2 (as shown symbolically by the arrows 10, 10'). Good wetting of the surface 3, 3' of the roll 1, 1' by the liquid steel inhibits entrainment of the boundary layer of gas, present near the surface 3, 3' of the roll 1, 1', between the roll 1, 1' and the solidified shell 5, 5', thereby preventing the possibility of a hollow marking being formed on the surface of the strip 7. The presence of such a contact angle makes the shape and position of the meniscus somewhat unstable, which in turn introduces significant variations in the manner in which the shells 5, 5' start to solidify. In addition, the gas entrainment has a somewhat random influence on the composition and the volume of the gas forming the gas blanket present in the dimples 2, and this too causes the shells 5, 5' to solidify in a heterogeneous manner. It is probable that these phenomena at the meniscus 8, 8' make it difficult to achieve and permanently maintain casting conditions which would prevent the appearance of surface crazes.

Methods have already been proposed for improving the stability of the conditions at the meniscus 8, 8'. According to one of them, the meniscus 8, 8' is subjected to vibrations, either by making the rolls 1, 1' vibrate (document EP-A-0,670,757) or by immersing an ultrasonic emitter in the liquid steel 4 (document EP-A-0,684,098) or by applying electromagnetic fields to the liquid steel in the region of the meniscus 8, 8' (EP-A-0,754,515). This method has the drawback of requiring special equipment which complicates the construction of the casting plant. According to another method (document EP-A-0,732,163), rolls with a very low roughness (Ra<5 $\mu$m) are used and deoxidation products are formed inside the liquid metal 4, by acting on its composition, these substances improving the wetting conditions at the meniscus 8, 8'. However, this method means that there must be a relatively high concentration of oxidized inclusions within the liquid metal 4. This excludes the possibility of thin strip being cast from extremely clean steels, i.e. steels having the very low level of inclusions required for many uses of carbon-steel strip. It has also been proposed (EP-A-0,740,972, already mentioned) for the use of a finely grooved surface of the rolls to be coupled with the addition of at least 0.02% of sulfur in order to obtain more uniform heat-transfer conditions. These methods only apply if the rolls 1, 1' have a very low roughness (Ra of a few $\mu$m) and their prime purpose is to increase the intensity of heat transfer between the rolls 1, 1' and the liquid metal 4. Now, it has been found that such conditions can cause surface crazes to appear. These methods of the prior art cannot therefore solve the problem posed by this appearance of crazing. Furthermore, as already mentioned, excessive extracted heat fluxes shorten the life of the outer surfaces of the rolls, the manufacture of these outer surfaces and the process of fitting them over the cores of rolls both being very expensive operations. Finally, the presence of such a large amount of sulfur in the metal limits the range of applications of the products that will be manufactured from the cast strip.

According to the invention, this appearance of crazing during the casting of thin carbon-steel strip is considerably curtailed, or even completely eliminated, by satisfying the following conditions:

- the steel used has a composition which comprises, by weight based on total weight, a carbon content of the steel less than 0.5%, a manganese content between 0.4 and 2%, a silicon content less than 2% and a %Mn/%Si ratio between 3 and 16;
- The dimples 2 are contiguous and distributed randomly over the surfaces 3, 3' of the rolls 1, 1' and give these surfaces 3, 3' a roughness Rz of between 40 and 130 $\mu$m and a roughness Ra of between 10 and 20 $\mu$m; and
- the atmosphere surrounding the meniscus 8, 8' is at least 40% nitrogen.

Figure 2:
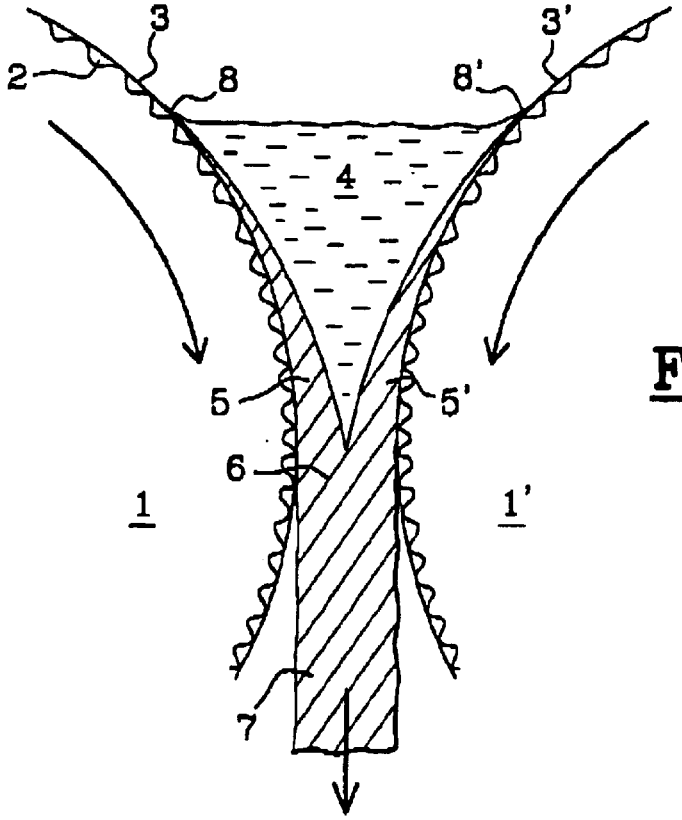
FIG. 2, which diagrammatically illustrates the behavior of the meniscus in the case of the invention.

By satisfying these conditions, it is possible to obtain a meniscus 8, 8' which has the configuration shown in FIG. 2, namely an obtuse contact angle between the surface 3, 3' of the roll 1, 1' and the liquid steel 4. Any entrainment of gas 10 between the meniscus 8, 8' and the surface 3, 3' of the roll 1, 1' is thus eliminated. The gas present in the dimples 2 during formation of the shells 5, 5' was therefore in its entirety already present before contact with the meniscus 8, 8' and thus more stable and more easily reproducible conditions for initiating and developing the solidification of the shells 5, 5' are obtained than under the conditions of the prior art. The position of the meniscus 8, 8' is also more stable, without it being necessary for this purpose to use means for vibrating the meniscus 8, 8', such as those described above.

While not bound by a particular theory, one possible explanation for this creation of favorable wetting conditions is that when the steel has the composition mentioned, there is significant evaporation of manganese and, to a lesser extent, of silicon, these elements being deposited on the surfaces 3, 3' of the rolls 1, 1'. This coating, which is constantly being renewed during the casting run, probably imparts favorable properties to the roll/steel interfaces, as long as the surrounding atmosphere is virtually free of oxygen which could combine with the evaporated elements and modify the composition of the coating. Below a %Mn/%Si ratio of 3 and above a %Mn/%Si ratio of 16 these particularly favorable wetting conditions are not obtained.

Experiments by the inventors have shown that the absence of surface crazing on the strip 7 is achieved when these wetting conditions are combined with the use of a gaseous environment and of rolls 1, 1' which satisfy the abovementioned criteria. These conditions allow transfer of roughness between the shells 5, 5' and the rolls 1, 1' with satisfactory uniformity.

A preferred condition for obtaining the desired result is to carry out the casting without using a coverage material, therefore leaving the surface of the liquid metal 4 bare, so as not to disturb the evaporation of the volatile elements and their deposition on the rolls 1, 1'.

The process according to the invention is compatible with the presence of aluminum in the steel. As is known, this presence of aluminum may be accompanied by an addition of a few tens of ppm of calcium intended to convert the alumina inclusions into liquid lime-based aluminates at the melting point of the steel. In this way, the pouring orifices in the tundish are prevented from being blocked by alumina inclusions and the oxidized inclusions are given a plasticity and a morphology which are well suited to the thermomechanical treatments that the strip will undergo subsequently, as well as to the future uses of the products that will be produced therefrom. It is also conceivable to partially or completely replace the aluminum with other highly deoxidizing elements, such as titanium and/or zirconium. The total maximum content of these strong deoxidants preferably is 0.1%.

Compared with the other methods proposed above for obtaining a very stable meniscus 8, 8' (which methods, it will be recalled, will not allow a strip 7 free of surface crazing to be reliably obtained), the process according to the invention has the advantage of not requiring the presence within the liquid steel 4 of a relatively large quantity of oxidized inclusions which could be unfavorable for many uses of the end metal. In addition, these oxide inclusions would carry the risk of forming plates near the meniscus, which plates could be trapped by the shells 5, 5'. The quality of the surface of the strip 7 would thus deteriorate. It is considered to be preferable not to exceed a total oxygen content of 100 ppm (that is to say oxygen present in dissolved form or in combined form in oxidized inclusions) and preferable to maintain this content between 30 and 70 ppm. This total oxygen content depends largely on the content of dissolved oxygen which is determined by the chemical equilibria between the liquid steel 4 and its environment, and especially by the contents in the liquid steel 4 of deoxidizing elements, namely manganese, silicon and possibly aluminum. One way of obtaining a low oxygen content (and therefore an end-product with a low level of inclusions) in the liquid steel 4 at the moment it solidifies, even if it does not contain very strong deoxidants such as aluminum or titanium, is to impose such a low content during the in-ladle smelting of the steel by establishing a chemical equilibrium between the metal and a slag highly enriched with lime and depleted of silicon and manganese oxides and, thereafter, to prevent, as far as possible, atmospheric oxygen from penetrating the liquid steel 4, by carefully inerting the casting plant.

It is not necessary, either, to insist on there being a large amount of sulfur in the liquid metal 4, which would lead to a restriction in the possible ways of using the products manufactured from the cast strip. Sulfur is an element whose presence in most carbon steels having good mechanical properties it is desirable to limit. The presence of carbon with a maximum content of 0.5% is not very restricting insofar as most carbon steels that it may be desired to cast in the form of thin strip satisfy this characteristic.

The best results are obtained with an atmosphere surrounding the free surface of the liquid steel 4 comprising 100% nitrogen. However, it is tolerable for this content to be as low as 40%, the balance being composed of an inert gas insoluble in the steel (such as argon or helium) or of a mixture of such gases. By varying the composition of the inerting gas it is possible, as is known, to vary the intensity of heat transfer between the rolls 1, 1' and the liquid steel 4 and to vary the productivity of the plant as well as the shape of the rolls resulting from their expansion (document EP-A-0,736,350).

All these results are obtained in the case of the use of rolls 1, 1' whose surfaces 3, 3' are made of copper or copper alloy, optionally covered with a skin of a nickel-based or chromium-based alloy, as is often the case.

One conventional, rapid and inexpensive method of forming the dimples 2 on the surfaces 3, 3' of the rolls 1, 1' is to blast said surfaces 3, 3' with metal or ceramic balls. By varying the number, materials, diameters and blasting pressure of the balls, it is possible to achieve the desired configurations of said dimples 2. Other methods (using a laser or chemical etching or electrical-discharge machining of the surfaces 3, 3', or marking of the surfaces 3, 3' by knurling) are also conceivable.

If the casting conditions would lead to the presence on the surface of the strip 7 of projections that are somewhat too great, as a result of a relatively high penetration of the liquid 4 into the dimples 2, provision may be made for the strip 7 to be hot rolled in order to flatten these projections, preferably on an apparatus placed in line with the casting plant.

EXAMPLES

By way of example, mention may be made of the case of the casting of strip 2.6 mm in thickness, made of a steel having the composition: C=0.042%; Mn=0.816%; P=0.006%; S=0.005%; Si=0.220%; Al=0.002%; Ni=0.066%; Cr 0.126%; Cu=0.085%; N=0.0058%. The roughness of the rolls was defined by an Ra of 21 $\mu$m and an Rz of 92 $\mu$m, these being obtained by blasting with steel balls. The compositional and roughness characteristics were therefore in accordance with the invention (particularly the %Mn/%Si ratio was equal to 3.7). When, according to the invention, the surface of the liquid metal was inerted by pure nitrogen or by a 50/50% nitrogen/argon mixture, no crazes on the surface of the strip were observed. On the other hand, inerting with 100% argon caused crazes to appear, although these were relatively few in number.

In addition, a 2.6 mm thick strip, whose composition was: C=0.0426%; Mn=0.303%; P=0.004%; S=0.0007%; Si=0.186%; Al=0.003%; Ni=0.035%; Cr=0.075%; Cu=0.031 %; N=0.0044%, for example, was cast as a control. The %Mn/%Si ratio this time was 1.6, and therefore not according to the invention. The roughness of the rolls was the same as for the previous casting run. The surface of the liquid metal was inerted by a 70/30% argon/nitrogen mixture. The last two characteristics fell outside the requirements of the invention. Under these conditions, the appearance of significant crazing on the surface of the strip was observed.

A 2.6 mm thick strip, having as composition: C=0.054%; Mn=0.601%; P=0.007%; Si=0.004%; Si=0.320%; Al=0.003%; Ni=0.040%; Cr=0.100%; Cu=0.028%; N=0.0059%, was cast as another control. The %Mn/%Si ratio was 1.9, and therefore not according to the invention. The rolls had an Ra of 8 $\mu$m and an Rz of 35 $\mu$m, and therefore an insufficiently pronounced roughness to be able to fall within the conditions of the invention. The inerting gas was 100% nitrogen. Here again, a significant number of crazes was observed on the surface of the strip.

Another particularly advantageous casting run was carried out in order to obtain a 3.9 mm thick strip. Its composition was: C=0.049%; Mn=0.791%; P=0.005%; S=0.006%; Si=0.200%; Al=0.003%; Ni=0.028%; Cr=0.049%; Cu=0.015%; N=0.0052%. The %Mn/%Si ratio was 4, and therefore according to the invention. The surface of the metal was inerted by pure nitrogen or by a 50/50% nitrogen/argon mixture. One of the rolls had an Ra of 21 $\mu$m and an Rz of 92 $\mu$m (according to the invention) and the other had an Ra of 8 $\mu$m and Rz of 35 $\mu$m (outside the invention). It turned out that the face of the strip which solidified against the roll with a high roughness in accordance with the invention was free of crazes, whereas the opposite face of the strip, which solidified against the roll of low roughness, outside the invention, had many crazes. This last example clearly shows the fundamental influence of the roughness of the rolls on the final result, all other things being equal.

The invention therefore makes it possible to achieve good anchoring of the shells 5, 5' solidifying on the surfaces 3, 3' of the rolls in order to prevent crazes which would arise due to excessive brittleness of the shells 5, 5'.

All ranges noted herein include the endpoints of the range, and further include all values and subranges within each range. This is also the case for amounts denoted as "less than."

French patent application 99 03778 filed Mar. 26, 1999, is incorporated herein by reference.

What is claimed is:

1. A process for manufacturing carbon steel strip having a thickness of less than or equal to 10 mm directly from liquid steel comprising the steps of:

providing a liquid steel having a composition comprising, in percentages by weight based on total weight: carbon≦0.5%, manganese from 0.2 to 2%, silicon≦2%, the %Mn/%Si ratio being between 3 and 16, optionally aluminum+titanium+zirconium≦0.10%, iron and usual impurities;

casting said liquid steel between lateral surfaces of copper and copper alloy of two internally coated rotating horizontal rolls;

said lateral surfaces of said rolls have contiguous dimples giving said surfaces a roughness Rz of between 40 and 200 μm and a roughness Ra of between 10 and 40 μm; and the atmosphere surrounding the meniscus of said liquid steel present between said rolls contains between 40 and 100% nitrogen, any balance being an inert gas insoluble in said liquid steel or of a mixture of such inert gases.

2. The process as claimed in claim 1, wherein said liquid steel comprises ≦100 ppm of total oxygen.

3. The process as claimed in claim 2, wherein said liquid steel comprises 30 to 70 ppm of total oxygen.

4. The process as claimed in claim 1, wherein said contiguous dimples are distributed randomly over the surfaces of said rolls.

5. The process as claimed in claim 1, wherein the atmosphere surrounding said meniscus of said liquid steel present between said rolls is 100% nitrogen.

6. The process as claimed in claim 1, wherein the surface of said liquid steel present between said rolls is free of coverage material.

7. The process as claimed in claim 1, wherein said process further comprises hot rolling of said strip.

8. The process as claimed in claim 7, wherein said hot rolling is carried out in line, after said strip has been cast.

9. A carbon-steel strip having a thickness of less than or equal to 10 mm, which is obtained by the process as claimed in claim 1.

10. The process as claimed in claim 1, wherein said copper or copper alloy has a skin which is a nickel alloy or a chromium alloy.

11. The process as claimed in claim 1, wherein said strip has a thickness of 2 to 6 mm.

* * * * *